US006102477A

United States Patent [19]

Kurtz

[11] Patent Number: 6,102,477

[45] Date of Patent: Aug. 15, 2000

[54] CHAIR WITH TILT LIMITER

[75] Inventor: Eric J. Kurtz, Rock Island, Ill.

[73] Assignee: HON Technology Inc., Muscatine, Iowa

[21] Appl. No.: 09/038,530

[22] Filed: Mar. 11, 1998

[51] Int. Cl.[7] ..... A47C 7/60

[52] U.S. Cl. ..... 297/301.7; 297/302.3; 297/302.7

[58] Field of Search ..... 297/316, 302.3, 297/301.7, 301.6, 300.8, 300.7, 302.6, 302.7, 301.3, 301.1

[56] References Cited

U.S. PATENT DOCUMENTS

| | | | |
|---|---|---|---|
| 3,250,567 | 5/1966 | Parrott | 297/301.3 |
| 4,123,103 | 10/1978 | Doerner | 297/301.6 X |
| 4,198,094 | 4/1980 | Bjerknes et al. | 297/300.7 X |
| 4,537,445 | 8/1985 | Neuhoff | 297/300.8 X |
| 4,840,426 | 6/1989 | Vogtherr et al. | 297/300.8 X |
| 5,417,473 | 5/1995 | Brauning | 297/302.3 |
| 5,658,045 | 8/1997 | Van Koolwijk et al. | 297/301.7 X |
| 5,664,834 | 9/1997 | Hsu | 297/300.8 X |
| 5,683,139 | 11/1997 | Golynsky et al. | 297/302.3 |
| 5,765,914 | 6/1998 | Britain et al. | 297/302.7 X |
| 5,775,774 | 7/1998 | Okano | 297/316 X |

*Primary Examiner*—Peter M. Cuomo
*Assistant Examiner*—Stephen Vu
*Attorney, Agent, or Firm*—Jones, Day, Reavis & Pogue

[57] ABSTRACT

A chair has a control mechanism configured to limit the angle of tilt of the chair back rest relative to the seat. The control mechanism includes a bracket member configured to be supported on a vertical column of a chair base. A rotational member attachable to the chair back rest is supported for rotation on an end of the bracket member. A generally elongated stop member is secured to the tubular member at a position extending inwardly of the end of the bracket member. A slide member extends along the longitudinal axis of the bracket member and has one end provided with at least one downwardly directed inclined edge. The stop member has a free distal end configured to engage the inclined edge and limit rotation of the tubular member. By this arrangement, the chair user can adjust the degree of rearward tilt of the back rest by selected movement of the slide member longitudinally of the bracket member.

6 Claims, 3 Drawing Sheets

CHAIR WITH TILT LIMITER

BACKGROUND OF THE INVENTION

1. Field of the Invention

The present invention relates generally to an office chair in which the back rest is pivotable relative to the chair base and, more particularly, to a mechanism which selectively limits the angle of tilt of the back rest.

2. Description of the Related Art

Many chairs are available for use in office environments in which the back rest of the chair is pivotable relative to the chair base. These chairs have the advantage of allowing the user to periodically adjust his or her seating position and avoid fatigue which can accompany being seated in a single position for prolonged periods of time. An example of such a chair is disclosed in U.S. Pat. No. 4,792,187.

Often, chair controls which allow for tilting of either the seat or back rest of a chair can be somewhat complex and expensive devices. Typically, these devices use spring and linkage systems which serve to bias the chair back rest and limit its movement so that the back rest can tilt only through a preferred angle. Excessive tilt, for example, can cause the chair to be unstable as the user leans back in the chair.

Accordingly, it is desirable to provide a control for a chair which is capable of selectively limiting the angle of tilt of the chair back rest in a positive and reliable manner. It is further desirable to provide such a control which is simple and cost effective to manufacture. Still further, it is desirable to provide such a control which is easy to operate by the chair's user.

SUMMARY OF THE INVENTION

The present invention improves over the prior art by providing a chair having a control mechanism configured to limit the angle of tilt of the chair back rest relative to the seat. The control mechanism includes a bracket member configured to be supported on a vertical column of a chair base. A rotational member attachable to the chair back rest is supported for rotation on an end of the bracket member. A generally elongated stop member is secured to the tubular member at a position extending inwardly of the end of the bracket member. A slide member extends along the longitudinal axis of the bracket member and has one end provided with at least one downwardly directed inclined edge. The stop member has a free distal end configured to engage the inclined edge and limit rotation of the tubular member. By this arrangement, the chair user can adjust the degree of rearward tilt of the back rest by selected movement of the slide member longitudinally of the bracket member.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENT

Figure 1:
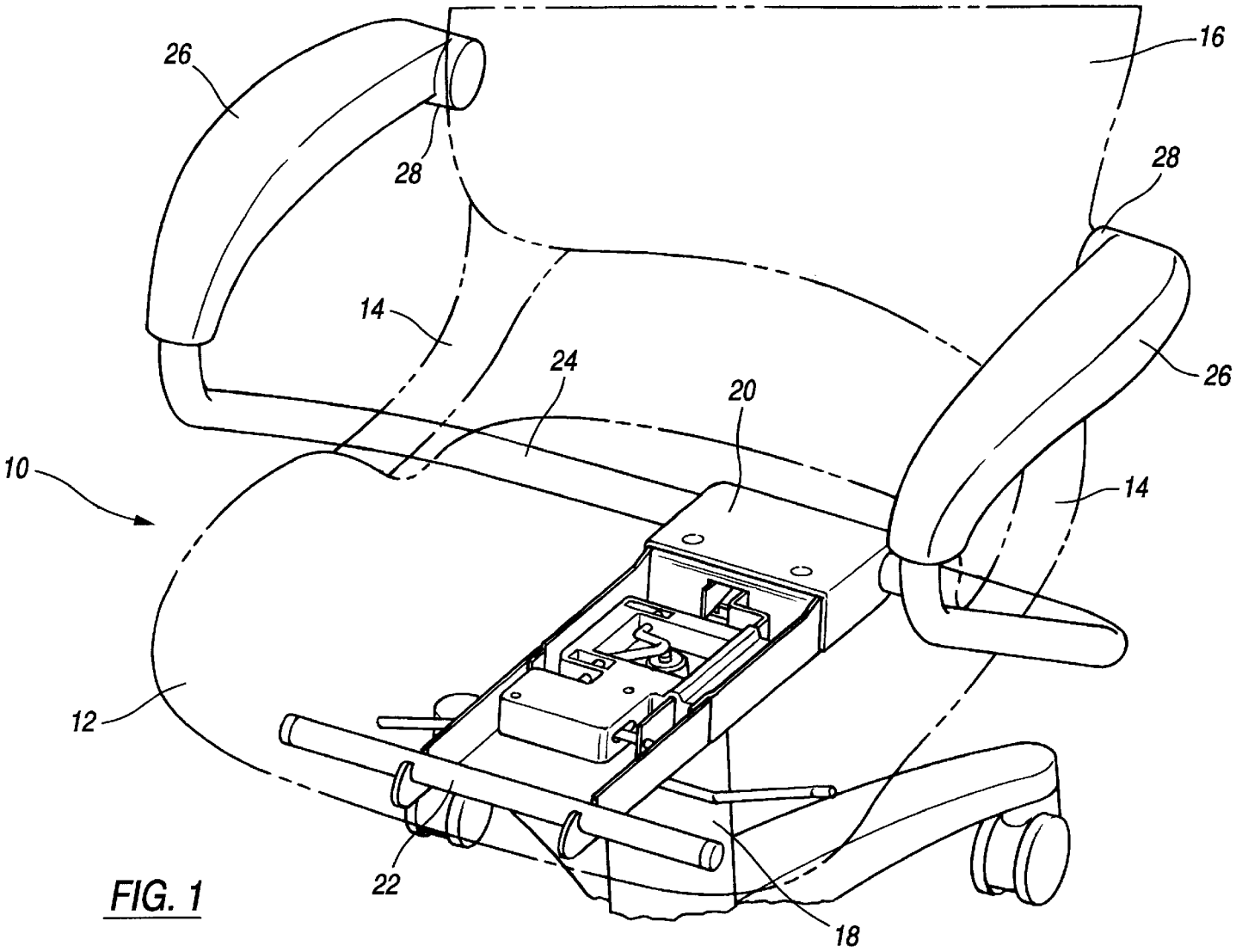
FIG. 1 is a partial perspective view of a chair having a control mechanism constructed in accordance with the principles of the invention, the chair being illustrated partially in phantom.

Referring now to the drawings and initially to FIG. 1, a chair of the type suitable for use in an office environment is designated generally by the reference numeral 10 and includes a seat 12 connected by flexible supports 14 to a backrest 16. The seat 12 is supported on a pedestal base assembly 18 by a control mechanism 20. In the illustrated chair 10 the front of the seat 12 is pivotally connected to the control mechanism 20 by a transverse rod 22 spanning the front of the mechanism 20. At the rear of the control mechanism 20 a tubular member 24 is journalled for rotation by the mechanism 20. The tubular member 24 may advantageously extend forwardly upwardly to support a pair of arm rests 26 and connect to opposed sides of the back rest 16 at pivot points 28. The tubular member 24 may also be constructed to attach directly to the back rest 16 without forming arm rests 26.

Figure 2:
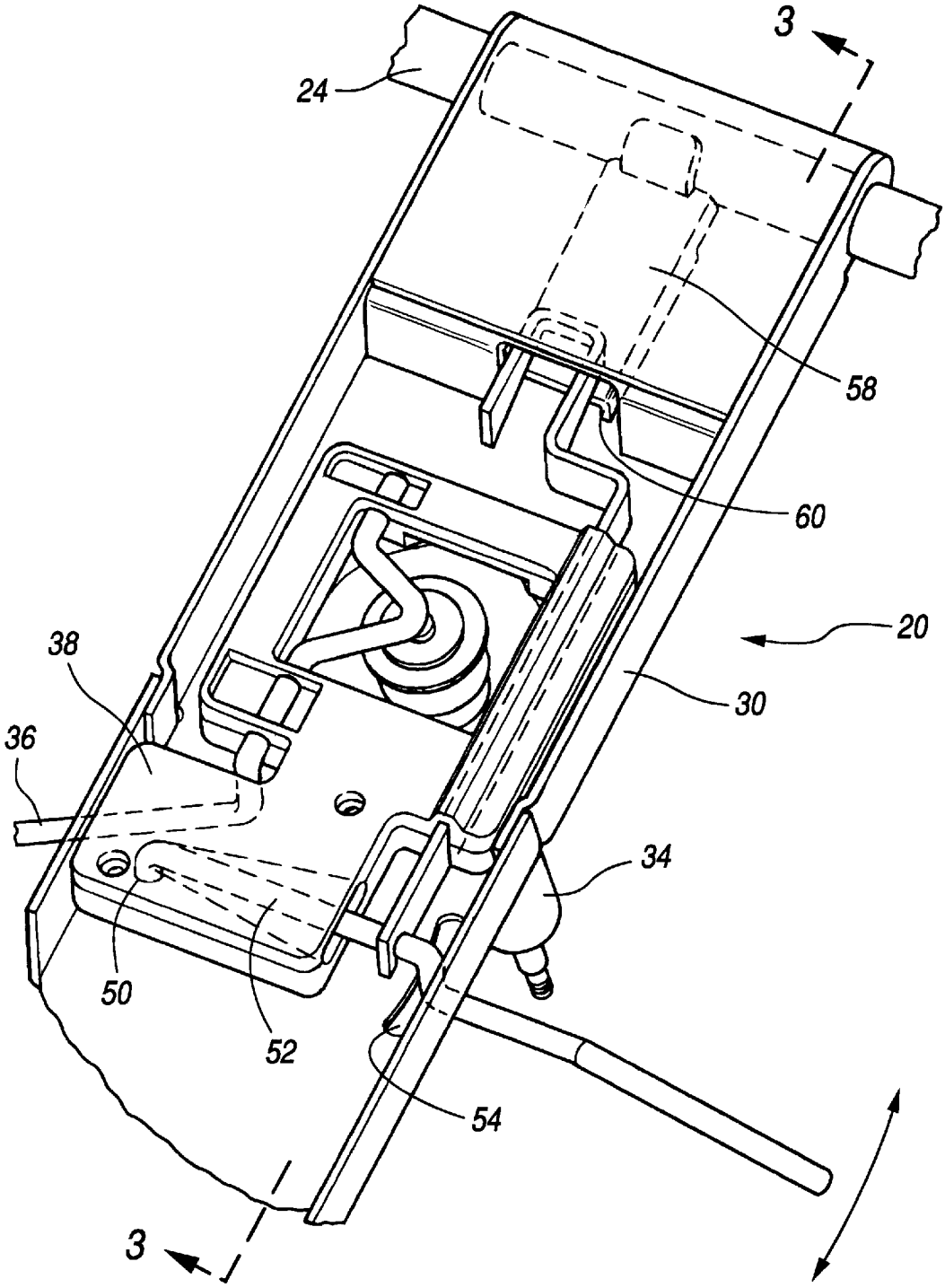
FIG. 2 is a top perspective view of the chair control mechanism.
Figure 3:
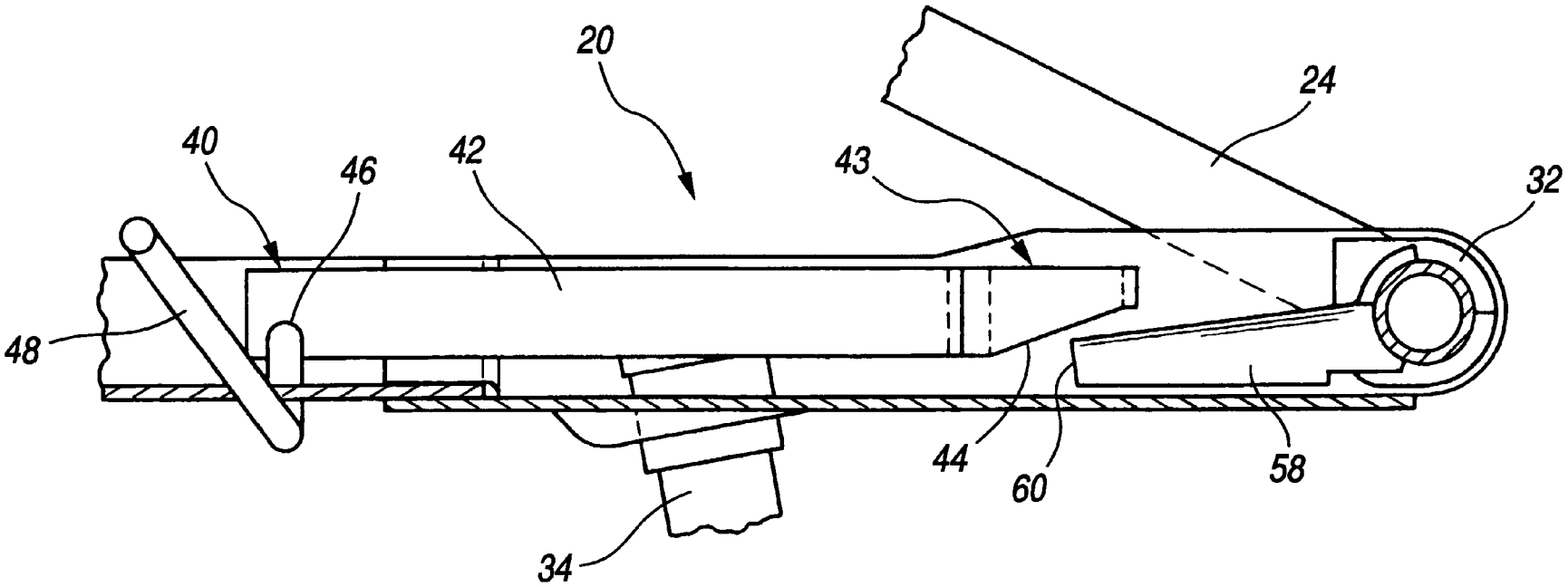
FIG. 3 is a partial cross-sectional view taken substantially along the line 3—3 of FIG. 2.

The details of the control mechanism 20 can best be seen in FIGS. 2 and 3. A principal component of the mechanism 20 is a bracket member 30 which is preferably stamped and formed from suitable sheet metal. The rear of bracket member 30 which journals the tubular member 24 may be provided with a suitable bearing 32. In a manner well-known in the art the bracket member 30 is fitted onto a pneumatic cylinder 34 for selective height adjustability of the chair 10. The cylinder 34 is operated by a lever 36 supported by a secondary bracket 38 attached to the bracket member 30.

In accordance with the invention, the control mechanism 20 includes a slide member 40 having a first leg portion 42 extending longitudinally of the bracket member 30 and offset to one side of the centrally located cylinder 34. One end of the slide member 40 is formed with a generally U-shaped portion 43. As best seen in FIG. 3, the U-shaped portion 43 is provided with a pair of spaced, mutually aligned, downwardly facing ramped edges 44. The other end of the slide member 40 is provided with an aperture 46 through which a lever 48 extends. The lever 48 is supported for pivotable movement in an aperture 50 provided in the bracket 38 and has an intermediate portion 52 which passes through an arcuate slot 54 formed in the bracket member 30. By selective movement of the lever 48, as shown by the arrow, the slide member 40 is thereby moved fore and aft of the control mechanism 20. Further, a generally elongate stop member 58 is fixed to the tubular member 24 along the longitudinal axis of the control member 20 as by welding or the like. Free distal end 60 of the stop member 58 extends beneath the sloped surfaces of the U-shaped end 42 of the slide member 40 and engages the ramped edges 44 of the slide member 40. The cooperation of the stop member 58 with the ramped edges 44 of the slide member 30 thereby limits the degree of rearward rotation of the tubular member 24 (or clockwise as viewed in FIG. 3). The degree of rotation of the tubular member 24 is adjusted by actuating the lever 48 and positioning the slide member 40 at a preferred longitudinal location within the control 20 which, in turn, determines the point at which the ramped edges 44 of the slide member 30 are contacted by the stop member 58.

It can now be appreciated that the chair 10 of the present invention has considerable advantages with respect to providing comfort to the user in an inexpensive and highly effective manner due to the specific construction of its control mechanism 20. The control mechanism 20 serves to allow the chair user to selectively adjust the tilt of the back rest 16 to one of a range of possible angles depending on the preferences of the user. The mechanism 20 can also be seen to be cost-effectively manufactured and readily assembled in a variety of chair constructions.

While the present invention has been described in connection with a preferred embodiment thereof, it will be apparent to those skilled in the art that many changes and modifications can be made without departing from the true spirit and scope of the invention. Accordingly, it is intended by the appended claims to cover all such changes and modifications as come within the spirit and scope of the invention.

What is claimed is:

1. A chair having a control mechanism configured to limit an angle of tilt of a chair back rest assembly relative to a chair seat, said chair comprising:

a bracket member configured to be supported on a vertical column of a chair base;

a rotational member supported for rotation on an end of said bracket member, said rotational member being attached to the chair back rest;

a generally elongate stop member secured to said rotational member at a position extending inwardly of said end of said bracket member; and a slide member slidable along a longitudinal axis of said bracket member and having a first generally U-shaped end provided with two mutually aligned and spaced downward directed inclined edges for engagement with said stop member;

said stop member having a free distal end configured to engage said inclined edges of said slide member and limit rotation of said rotational member and the chair back rest;

wherein said rotational member is rotatable through one of a plurality of ranges of degrees of rotation as determined by a specific position of said slide member along said longitudinal axis.

2. The chair of claim 1 wherein a second end of said slide member is connected to a laterally extending lever.

3. The chair of claim 2 wherein said lever has a first free end extending outwardly of said control and has a second end pivotally connected to said bracket member.

4. The chair of claim 3 wherein an intermediate portion of said lever passes through an arcuate slot provided in said bracket member.

5. The chair of claim 2 wherein said lever extends through an aperture of said slide member.

6. A chair having a control mechanism configured to limit an angle of tilt of a chair back rest assembly relative to a chair seat said chair comprising:

a bracket member configured to be supported on a vertical column of a chair base;

a rotational member supported for rotation on an end of said bracket member, said rotational member being attached to the chair back rest;

a generally elongate stop member secured to said rotational member at a position extending inwardly of said end of said bracket member; and a slide member slidable along a longitudinal axis of said bracket member and having a first end provided with at least one downwardly directed inclined edge;

said stop member having a free distal end configured to engage said inclined edge of said slide member and limit rotation of said rotational member and the chair back rest;

wherein said rotational member is rotatable through one of a plurality of ranges of degrees of rotation as determined by a specific position of said slide member along said longitudinal axis.

* * * * *